United States Patent [19]

Petit

[11] 3,977,809

[45] Aug. 31, 1976

[54] CONTROLLED DISCHARGE PRESSURE PUMP FOR PUMPING LIQUIDS

[75] Inventor: Albert Alfred Paul Petit, Paris, France

[73] Assignee: A. Petit & Co. S.A.R.L., Paris, France

[22] Filed: Feb. 10, 1975

[21] Appl. No.: 548,359

[30] Foreign Application Priority Data

Feb. 14, 1974 France ..... 74.05031

[52] U.S. Cl. ..... 415/29; 415/149 R

[51] Int. Cl.[2] ..... F01D 17/02; F01D 17/08

[58] Field of Search ..... 415/11, 149, 26, 27, 415/28, 29; 417/199 A

[56] References Cited

UNITED STATES PATENTS

| | | | |
|---|---|---|---|
| 1,206,385 | 11/1916 | Sperry | 415/11 |
| 1,997,418 | 4/1935 | Hornschuch et al. | 415/11 |
| 2,018,555 | 10/1935 | Heaney | 415/29 |
| 2,391,769 | 12/1945 | Campbell | 415/11 |
| 2,470,565 | 5/1949 | Loss | 415/27 |
| 2,756,982 | 7/1956 | Tuscher | 415/29 |
| 3,726,618 | 4/1973 | Dicmas | 415/11 |

FOREIGN PATENTS OR APPLICATIONS

| | | | |
|---|---|---|---|
| 1,369,310 | 7/1964 | France | 417/199 A |
| 2,082,396 | 12/1971 | France | 417/199 A |

*Primary Examiner*—Henry F. Raduazo
*Attorney, Agent, or Firm*—Jay L. Chaskin

[57] ABSTRACT

A variable liquid discharge flow rate pump with a discharge float valve the opening of which is controlled according to the discharge pressure and flow rate by a hydraulic power ram actuator with a resiliently biased piston slidable in a cylinder communicating with or forming a container space for transit of liquid from a first cavity in which prevails the discharge pressure to a second cavity in which prevails the inlet pressure, the hydraulic circuit comprising at least one passageway providing a head loss variable according to the discharge flow rate and pressure.

8 Claims, 3 Drawing Figures

Figure 1:
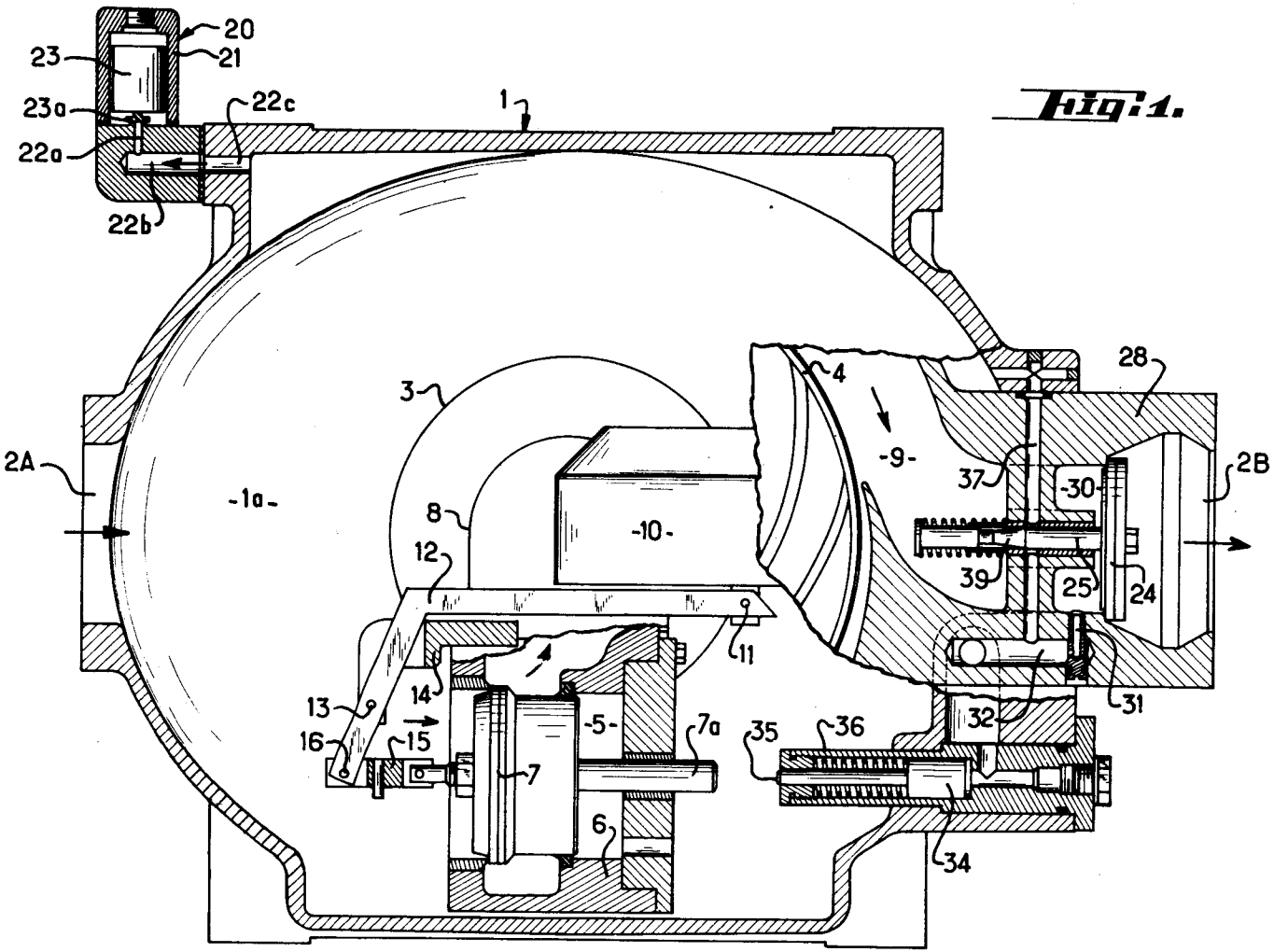

38b
38a
29
-P3-
28
4
37
-9-
2B
24
-30-
-P1-
28a
39a
-25-
26
39
27
28a
32b
31
-32a-
32
32c
-P2-
32d
36a
36
-34-
32e
35
33
32f

CONTROLLED DISCHARGE PRESSURE PUMP FOR PUMPING LIQUIDS

The present invention relates to a variable flow rate pump in which is provided a control of the discharge, delivery or output pressure such that the latter may not exceed a set maximum value.

This pump is either of the centrifugal or volumetric kind and comprises in particular as known per se a tank-like casing or chamber connected to an inlet port for the liquid to be pumped and a valve arranged within said chamber and the rod or spindle of which is connected to a float member the position of which depends upon the level of liquid in the chamber so that the discharge or delivery flow rate of the liquid provided by the pump may vary and possibly stop or be discontinued without any air or gas discharge and this in particular according to casual variations in the flow rate feeding the chamber.

A centrifugal pump having a discharge or output flow rate controlled in the above manner is disclosed in French Pat. No. 2,082,396 applied for on Mar. 13, 1970 by Mr. Jean DELSUC for: "A pumping device for the distribution of gas free liquid." A volumetric or positive displacement pump having a delivery flow rate controlled in the above manner is disclosed in French Pat. No. 1,369,310 applied for on Apr. 7, 1960 by the company called A. PETIT & Cie for "Method of designing a volumetric pump and variable delivery flow rate pump thus obtained" with reference to FIGS. 2 and 3 of that patent.

The pump according to the present invention may in particular have the basic structure of either of the pumps described in these prior art patents and moreover comprises means for controlling the discharge or delivery of output pressure in such a manner that it enables a discharge flow rate and pressure control under conditions which will be set forth with more detail hereinafter.

In spite of the significant advantages offered by the flow rate control and the removal of any gas or air flow circulation the aforesaid known pumps are not able to limit the discharge output pressure to some higher value considered for instance as being critical for liquid distribution circuit systems or plants.

Indeed when a valve mounted in a discharge or delivery pipe-line or duct is partially or fully closed the discharge pressure increases and the same holds true in the case of a centrifugal pump when the rotational speed of the rotor or rotary impeller is increased.

Thus when such a pump is driven by the power take-off of an automotive vehicle and the distribution circuitry includes flimsy parts or elements liable to get out of order such as flexible or yielding hose pipe-lines, flow-meters, and so on, the increase in the speed of the power take-off due for instance to an action exerted upon the accelerator results in a very noticeable discharge pressure rise which is likely to impair said elements or parts. In case of closing of a distributing circuit valve the discharge pressure may also rise significantly and cause the occurrence of the same inconveniences.

If the pump is connected through a hose or like flexible or yielding duct to a distributing gun the partial closure of the gun valve does not permit easily achieving an attendant reduction of the flow rate owing to the increase in the discharge pressure. Finally whether such a closing is partial or total the increase of such a pressure makes the coiling or winding up and the handling of the flexible hose connection difficult.

The pump according to the present invention enables to remove these various drawbacks.

The disclosed pump is of the kind including a tank-like case or chamber connected to an inlet port, a valve body arranged in said chamber and in the wall of the valve body there is provided a valve having a rod or spindle which is connected to a float member. The position of the float member depends upon the level of liquid available in the chamber. The cavity of said valve body communicates on the one hand with the inside space of said chamber or case through the valve and on the other hand either with the suction or inlet port of the pump rotor or impeller in the case of a centrifugal pump, the flow path through said valve then providing the only possible passageway for the transit or travel of liquid through said pump, or with the intake-delivery by-pass chamber of a volumetric or positive displacement pump having a cylinder mounted in eccentric relationship on a rotary shaft. This latter pump comprises means for controlling the opening of said valve according to the values of the discharge output pressure and the delivery flow rate with a view to control said discharge output pressure. This control means comprising a hydraulic circuit including a power ram actuator the resiliently biased piston of which is adapted to act upon said valve and the cylinder of which communicates with or forms an enclosed container space in said hydraulic circuit for the transit of liquid from a first cavity in which prevails the discharge pressure to a second cavity in which prevails the pressure inside the case or intake pressure.

According to the present invention said control means are such that when the discharge pressure tends to increase or when the pump output flow rate tends to decrease the actuating pressure for operating said piston tends to increase so as to act upon the value in such a direction that the discharge pressure tends to decrease.

In the case of a centrifugal pump built as previously stated said control means are designed so that according to the present invention the increase in the actuating pressure for operating said piston tends to close the valve thereby causing the pump output flow rate to drop since the flow path through said valve provides the only possible passageway for the flow or travel of liquid through said pump. The decrease in the flow rate entailing or being attended by a decrease in the discharge pressure so that an actual or effective control of this pressure is achieved.

If the pump is of said volumetric type with a by-pass chamber communicating on the one hand with the cavity of the valve body and on the other hand with any space in which prevails a pressure lower than that of said chamber, said control means are designed according to the present invention so that the increase in the actuating pressure for operating the piston acts on the contrary in the direction of opening of said valve thereby enabling to increase the liquid flow rate by-passed through said chamber and accordingly to lower the delivery flow rate of the pump as well as the discharge pressure.

It should be noted that in either case the increase in the operating pressure is obtained when the discharge output pressure tends to rise either due to the increase in the rotational speed of the pump impeller or rotor or in view of the partial or full closing of a valve provided in the liquid utilization or distribution circuit.

According to a preferred form of embodiment of the present invention said hydraulic circuit comprises for this purpose at least one passageway providing a variable head or pressure loss depending upon the delivery flow rate and the discharge output pressure.

According to a particularly advantageous characterizing feature of the invention that portion of the hydraulic circuit extending from the container space constituted by the cylinder of said power ram actuator to said second cavity comprises means for varying the liquid passageway cross-section under the action of a resiliently biased delivery valve thereby providing head loss variations when the valve in the delivery pipe-line or duct is closed and therefore the delivery valve tends to close.

According to another characterizing feature of the present invention that portion of said hydraulic circuit which extends from the first cavity to said container space comprises a callipered or restricted passageway the flow rate of which is a function of the discharge output pressure thereby providing a head loss when the discharge pressure increases.

According to a preferred form of embodiment of the invention the variation of the liquid passageway cross-section is provided by the displacement of the delivery valve. The variation is provided by having in the hydraulic circuit a duct across which the delivery valve rod or spindle extends. This rod or spindle has a cross-section which is gradually variable in a suitable direction in its portion adapted to slide transversely of said duct upon the opening or closing of the delivery valve.

Figure 2:
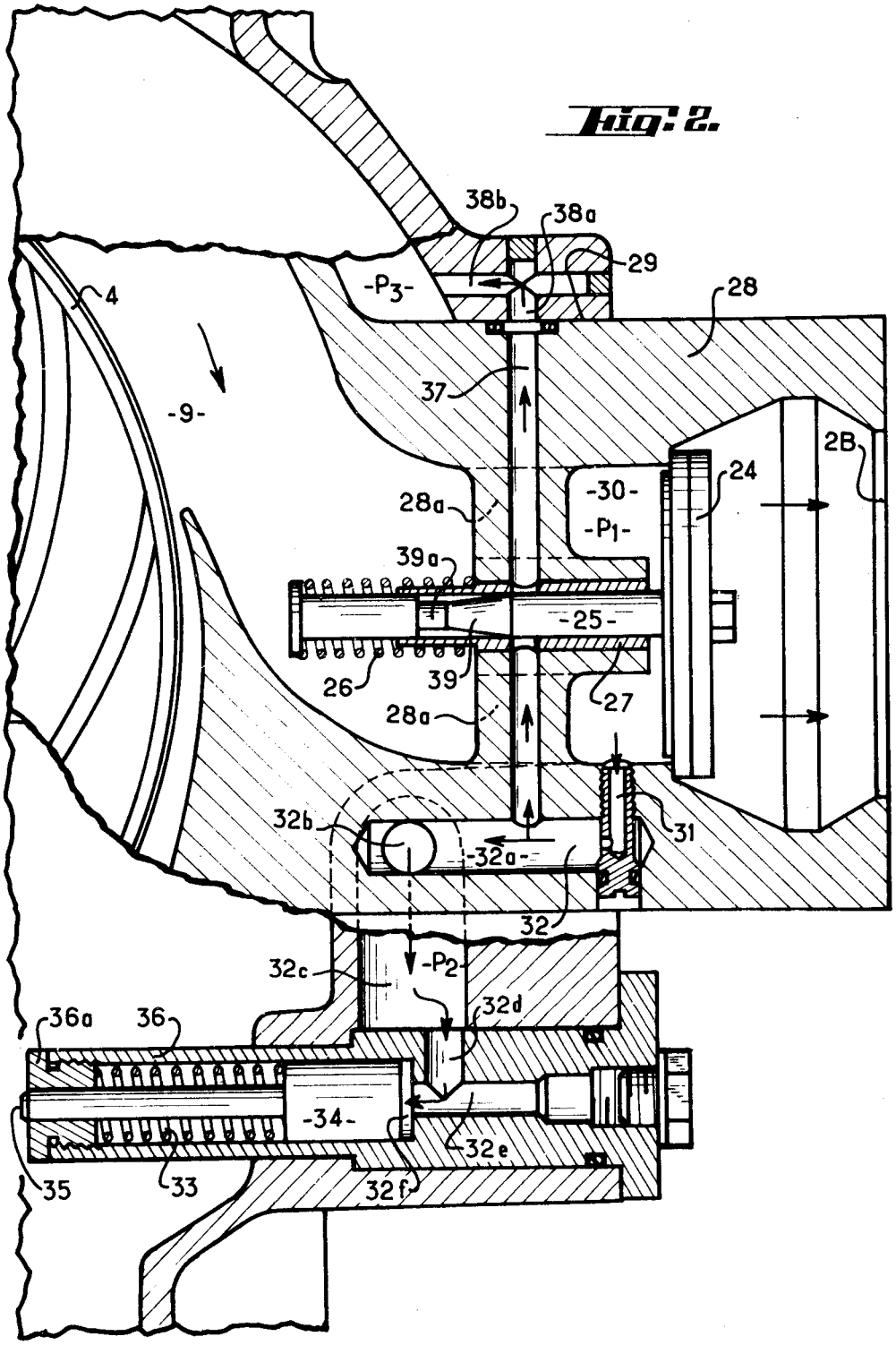
Figure 3:
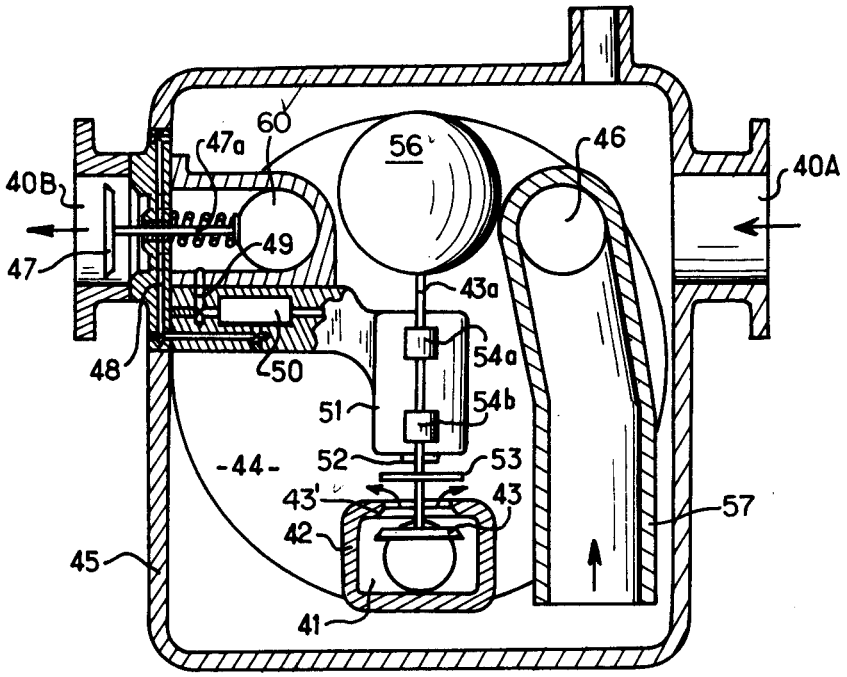

The invention will be better understood and further objects, characterizing features, details and advantages thereof will appear more clearly as the following explanatory description proceeds with reference to the accompanying diagrammatic drawings given by way of non-limitative examples only illustrating several presently preferred specific forms of embodiment of the invention and wherein:

FIG. 1 is a vertical cross-sectional view with parts broken away showing a pump according to a first form of embodiment of the invention, this pump being of the centrifugal type incorporating discharge pressure control means;

FIG. 2 is a view drawn on an enlarged scale of the part broken away in FIG. 1, this view showing in particular the control means; and FIG. 3 shows a view in vertical cross-section of a pump according to a second form of embodiment of the invention, this pump being of the volumetric or positive displacement type with a cylinder eccentrically mounted on a rotary shaft and incorporating means for controlling the discharge pressure.

The centrifugal pump shown in FIG. 1 corresponds to an improvement in the controlled flow rate centrifugal pump which is disclosed in the French Pat. specification publication No. 2,082,396 mentioned hereinabove, with reference to FIGS. 1 to 3 of this prior art patent, the present FIG. showing a view similar to that of FIG. 3 of said patent.

It should be recalled herein that such a pump essentially comprises a tank-like case or pan 1 provided with an inlet port 2A and with an outlet port 2B. The supply of liquid to and at the suction port 3 of the rotor or impeller 4 taking place exclusively by means of a flow of liquid through the cavity 5 of a valve body 6, which cavity communicates on the one hand with the inside space 1*a* of the case chamber or pan 1 through the medium of the valve 7 and on the other hand with the suction or induction port 3 through the medium of a duct 8. Delivery duct 9 directly receives the liquid drawn in and discharged through the revolving motion of the rotor 4. As known per se from said patent a float member 10 pivotally connected at 11 to an arm 12 pivotally connected in turn at 13 to a stationary support 14 is coupled with a valve 7 through the medium of a yoke or like clevis 15 to which the arm 12 is pivotally connected at 16. This rod or spindle 7*a* of the valve 7 extends through the valve body 6 so as to at least slightly project from the outer surface of this body in the closing position of the valve for reasons which will be explained hereinafter.

A liquid degassing device 20 is secured at the upper part of the pan-like case of bowl 1. Device 20 essentially comprises a casing or housing 21 communicating with the atmosphere, ducts 22*a* and 22*b* communicating with the inside space of the bowl 1 through the medium of a duct 22*c* and an element 33 fitted with a sealing end portion 23*a* for tightly closing the duct 22*a*. Element 23 is adapted to move under the action of the thrust of the gases coming from the pan or bowl 1 and to allow the latter to escape or be vented to the atmosphere when the level of the liquid is rising within said bowl.

On the right-end side of FIG. 1 and more specifically in FIG. 2 there is shown the discharge pressure control means as well as the structure of the check valve 24 referred to hereinafter as a delivery valve which is fitted at the discharge or outlet port 2B. It should be noted that the rod or spindle 25 of this valve resiliently drawn back or urged towards the closing position in the rest condition by the spring 26 is slidable in a sleeve 27 accommodated in a part 28 housed in an opening 29 of the pan or bowl 1. Part 28 extends into the inside of the bowl 1 to form the walls of the delivery duct 9. In the closing position of the valve 24 the latter defines a ring-shaped cavity or recess 30 which communicates with the delivery duct 9 through the medium of a plurality of bores 28*a* extending through the thinned central portion of the part 28. This annular cavity 30 communicates with a gauged cylindrical passageway 31 connected to an enclosed container space 32 including the successive ducts 32*a*, 32*b*, 32*c*, 32*d* and 32*e* as well as the chamber 32*f* of a linear displacement power ram actuator. Actuator 34 is resiliently biased or drawn back by spring 33. Piston rod 35 has its geometrical center-line concentric with the center-line of spindle 7*a*. Valve 7 extending in sliding relationship through the end plug or cap portion 36*a* of the cylinder 36 so as to be able to push or exert a thrust in engaging relationship upon the spindle 7*a*. The enclosed container space 32 communicates on the other hand with a duct 37 communicating in turn through the medium of the ducts 38*a* and 38*b* with the inside space 1*a* of the bowl or pan. This duct 37 has its centre-line meeting or intersecting the centre-line of the spindle 25 of the valve 24 and it therefore extends across the sleeve 27 surrounding said spindle. It should be pointed out that over a portion of its length the spindle 25 exhibits a portion 39 of gradually variable cross-sectional area which is here of tapering shape so that upon the opening of said valve (displacement of the spindle 25 towards the right-hand side on FIGS. 1 and 2) the free passageway cross-section for the liquid in the duct 37 is gradually increased. A decrease in the head or pressure losses within this duct therefore occurs upon the opening of the valve 24 and an increase in the head or pressure losses takes place upon the closing thereof. Thus the head loss through reduction of the free passageway cross-section for the liquid in the duct 37 depends directly upon the delivery flow rate of the pump. Moreover the head loss within the duct 37 depends also upon the flow rate *q* through the callipered passageway 31 and therefore upon the discharge pressure hereinafter denoted by $P_1$.

As the actuating pressure $P_2$ for operating the piston 34 is substantially equal to the pressure $P_3$ prevailing within the bowl 1 plus the head losses within the duct 37 it results therefrom that:

the operating pressure $P_2$ increases at the same time as or with the discharge pressure $P_1$ (because the flow rate *q* through the gauged passageway 31 increases);

said pressure $P_2$ increases when the delivery flow rate Q decreases (since the valve spindle 25 then gradually closes off the duct 37).

As shown in FIGS. 1 and 2 the pump which has just been described also comprises all the conventional suitable auxiliary means such as joint seals or like fluid-tight packing gaskets, cleaning ducts, plugs for closing or stopping same, etc . . .

The operation of the controlled flow rate and controlled discharge pressure pump according to FIGS. 1 and 2 is the following, these Figures showing the condition of the pump at rest.

The feed of liquid into the inlet port 2A results in the filling up of the pan or bowl and the rising motion of the float member 10 thereby operating the opening of the valve 7. The revolving of the rotor or impeller 4 enables the suction or drawing in of the liquid having entered the cavity 5 through the medium of the duct 8 and of the suction port 3 and to discharge it under pressure into the duct 9 thereby causing the delivery valve 24 to open. As long as the discharge output pressure does not exceed some given value and as long as the delivery flow rate has not become lower than some given value no interaction occurs between the rod 35 of the piston 34 and the spindle 7*a* of the valve 7 and the pump works in the same manner as that disclosed in the afore-mentioned French Pat. specification publication No. 2,082,396. In other words the opening of the valve 7 is depending upon the level of the liquid within the bowl 1 so that there occurs a regulation of the suction flow rate and accordingly of the delivery flow rate according to the variations in the flow rate feeding the bowl or housing 1.

With the valve 24 in the open position the portion 39 with restricted or narrowed cross-sectional area of the spindle 25 of said valve is then located across the duct 37 (more specifically it is the cylindrical portion 39*a* which lies within or across this duct when the valve 24 is fully open) so that the head loss of the liquid between the enclosed container space 32 and the bowl is minimum. Under such circumstances the hydraulic force exerted by the pressure $P_2$ prevailing within said enclosed container space upon the piston 34 is lower than the opposing force exerted by the biasing or return spring 33 and the piston 34 remains in the retracted position, in which position no interaction may occur between the rods 7*a* and 35 even in the fully open position of the valve 7. Now will be shown how the control device functions when the revolving speed of the rotor or impeller 4 increases and also when a valve (not shown) provided in the liquid distribution circuit downstream of the valve 24 is caused to be partially or fully closed.

It will be assumed that the pump operates normally and that the rotational spped of the rotor 4 is caused to be increased. The discharge pressure $P_1$ then tends to increase so that the controlling flow rate *q* through the gauged passageway 31 increases. This results in an increase in the head loss within the duct 37. The pressure $P_2$ increases and causes the piston 34 to move so that the rod 35 thereof is caused to engage and push the spindle 7*a* of the valve 7 thereby tending to close this valve and accordingly to decrease the delivery flow rate of the pump. The discharge output pressure $P_1$ tends therefore to decrease.

The control device is also operating as follows when a valve provided in the distribution circuit is caused to be closed. Assuming at first that this valve is caused to be closed partially; the delivery flow rate of the pump decreases so that the valve 24 closes partially. Owing to the displacement of the portion 39 of the spindle 25 to come in registery with the duct 37 (travel of this spindle towards the left) the free passageway cross-sectional area for the liquid within the duct 37 decreases so that the head loss increases. The pressure $P_2$ therefore increases and moves the piston 34 which will act upon the valve 7 in the closing direction thereof thereby resulting in a drop of the discharge pressure. If it is now assumed that the aforesaid valve is fully closed the delivery flow rate becomes zero and the pressure $P_1$ would be at an abnormally high value in the absence of the control means forming the subject matter of the present invention. On the contrary the use of these means provides a maximum head loss within the duct 37 (owing to the position of the spindle 25 which is the position shown in FIGS. 1 and 2) so that the pressure $P_2$ may increase and move the piston 34 so as to act upon the valve 7 in the closing direction thereof thereby causing the discharge pressure $P_1$ to decrease down to a new value substantially smaller than the discharge pressure in normal operation (for the same speed of the rotor).

The opening of the afore-mentioned valve entails the opening of the valve 24, the decrease in the head loss within the duct 37 and the decrease of the control or pilot pressure $P_2$ so that the piston 34 moves backwards and disengages the valve 7. It results therefrom that the delivery flow rate and the discharge pressure of the pump increase again.

The pump according to FIG. 3 corresponds to an improvement to the pump shown in FIGS. 2 and 3 of the aforesaid French Pat. No. 1,369,310; the pump according to the present FIG. 3 derives from the aforesaid pump through an adaptation on the latter of a discharge pressure control device of a type similar to that used on the present FIGS. 1 and 2. It should be recalled that the pump according to this second form of embodiment is of the volumetric or positive displacement type with a cylinder eccentrically mounted on a rotary shaft. This pump comprising a by-pass chamber between the inlet port 40A and the discharge or outlet port 40B (this chamber being designated by the reference numeral 17 in FIG. 2 of the French Pat. No. 1,369,310). The liquid inlet port 40*a* communicates with the inside space 44 of the bowl 45 and the suction duct 46 is connected to the inside space 44 via pipe 57. The liquid outlet port 40B is connected to the delivery duct 60. The cavity 41 of the body 42 of the valve 43 communicates on the one hand with the inside space 44 of the bowl 45 through the valve 43' as may be seen on the present FIG. 3 and on the other hand with the aforesaid by-pass chamber (as may be seen on FIG. 2 of the French Pat. No. 1,369,310). No communication is provided between cavity 41 and the suction duct 46. The pump according to the present FIG. 3 provides a delivery valve 47 having a spindle 47*a* which has a portion with a gradually variable cross-sectional area. A hydraulic regulation circuit comprises duct 48 in which a variable head or pressure loss is produced by the displacement of the spindle 47*a*, a callipered passageway 49 and an enclosed container space 50 connecting duct 48 to callipered passageway. The enclosed container space 50 is on the other hand connected to the chamber of a cylinder 51 the piston 52 of which is adapted to act upon a collar or like flange 53 secured to the spindle 43*a* of the valve 43. The valve spindle is guided by suitable guiding means 54*a* and 54*b* fitted to the outer wall of the cylinder 51. A float member 56 is attached to one end of the spindle 43*a*.

The motion of the piston 52 is functionally operated to produce the same results as that of the piston 34 of the pump according to the present FIGS. 1 and 2. The forward displacement of piston 52 (i.e. downwards or from top to bottom in the present FIG. 3) acts upon the valve 43 in the opening direction thereof. The effects which result therefrom would however be the same as in the pump according to the first form of embodiment since a larger opening of this valve is reflected by a larger by-pass flow rate (through the medium of the aforesaid by-pass chamber) so that the increase in the discharge pressure may be prevented in the same conditions as previously.

It should be understood that the invention is not to be limited to the forms of embodiment described and shown which have been given by way of examples only. In particular it comprises all the means constituting technical equivalents of the means disclosed as well as their combinations if the latter are carried out according to its gist and used within the scope of the appended claims.

What is claimed is:

1. A variable flow rate pump for pumping liquids comprising a bowl-like case having a liquid inlet port connected to an inside space of said bowl-like case said inside space defining a liquid retaining chamber; a liquid outlet port connected to a liquid circuit which includes rotative pumping means in said bowl-like case; a valve means connected to a float member adapted to follow the level of the liquid within said liquid retaining chamber of said bowl-like case; control means for controlling the valve means and therefore the discharge output pressure and delivery flow rate, respectively, including a hydraulic control circuit comprising a linear displacement actuator having a cylinder and a resiliently biased piston to act upon the valve means; an enclosed container space in liquid flow communication with the cylinder; a first duct between the enclosed container space and the liquid outlet port and a second duct between the enclosed container space and the inside space, the second duct having head loss varying means.

2. A pump according to claim 1 wherein the first duct comprises a gauged passageway.

3. A pump according to claim 1 comprising a resiliently biased delivery valve in the liquid outlet port and the second duct has a variable cross-sectional area on a part of its length.

4. A pump according to claim 3, wherein said delivery valve is provided with a delivery valve spindle having a section adapted to slide across said second duct, the section having a gradually variable cross-sectional area to provide the variable cross-sectional area of the second duct.

5. A pump according to claim 4, wherein the cross-sectional area of the delivery valve spindle is minimum in a first portion of said section which is across said second duct when said delivery valve is in the opening position and maximum in a second portion of said section which is across said second duct when said delivery valve is in the closing position.

6. A pump according to claim 1, wherein said rotative pumping means and liquid circuit are of the centrifugal type and the piston of said power ram actuator urges the valve means in the closing direction.

7. A pump according to claim 1 wherein said rotative pumping means and liquid circuit are of the volumetric type and the piston of said power ram actuator urges the valve means in the opening direction.

8. A pump according to claim 6 comprising a degassing valve in direct flow-communication with the bowl-like case to relieve the pressure within the case when the liquid is rising in the case.

* * * * *